US008210398B2

(12) United States Patent
Bondeson et al.

(10) Patent No.: US 8,210,398 B2
(45) Date of Patent: Jul. 3, 2012

(54) THERMALLY INSULATED APPLICATOR

(75) Inventors: Benjamin J. Bondeson, Suwanee, GA (US); Christopher R. Chastine, Lawrenceville, GA (US); Brett A. Pearson, Johns Creek, GA (US)

(73) Assignee: Nordson Corporation, Westlake, OH (US)

( * ) Notice: Subject to any disclaimer, the term of this patent is extended or adjusted under 35 U.S.C. 154(b) by 261 days.

(21) Appl. No.: 12/826,266

(22) Filed: Jun. 29, 2010

(65) Prior Publication Data

US 2011/0315713 A1 Dec. 29, 2011

(51) Int. Cl.
*B67D 7/80* (2010.01)

(52) U.S. Cl. ..... 222/146.2; 222/146.5; 222/567; 219/421

(58) Field of Classification Search ..... 222/146.2, 222/567, 146.5; 219/421–427
See application file for complete search history.

(56) References Cited

U.S. PATENT DOCUMENTS

| | | | | |
|---|---|---|---|---|
| 2,025,509 | A | | 12/1935 | Hieber |
| 3,818,930 | A | | 6/1974 | Crum et al. |
| 3,876,105 | A | * | 4/1975 | Kelling ..... 222/56 |
| 4,245,759 | A | | 1/1981 | Baker et al. |
| 4,334,637 | A | | 6/1982 | Baker et al. |
| 4,456,151 | A | * | 6/1984 | Lewellen ..... 222/146.5 |
| 4,711,379 | A | | 12/1987 | Price |
| 4,726,822 | A | | 2/1988 | Cates et al. |
| 4,752,670 | A | | 6/1988 | Traub et al. |
| 5,336,320 | A | | 8/1994 | Hogan et al. |
| 5,375,738 | A | | 12/1994 | Walsh et al. |
| 5,407,101 | A | | 4/1995 | Hubbard |
| 5,680,961 | A | * | 10/1997 | Boccagno et al. ..... 222/143 |
| 5,706,982 | A | | 1/1998 | Siddiqui et al. |
| 5,715,972 | A | * | 2/1998 | Siddiqui ..... 222/146.5 |
| 5,837,975 | A | | 11/1998 | Dillard et al. |
| 5,913,455 | A | | 6/1999 | La et al. |
| 5,934,520 | A | | 8/1999 | Byerly et al. |
| 6,049,658 | A | * | 4/2000 | Schave et al. ..... 392/472 |
| 6,056,155 | A | | 5/2000 | Byerly et al. |

(Continued)

FOREIGN PATENT DOCUMENTS

DE 3214726 A1 10/1983

(Continued)

OTHER PUBLICATIONS

Nordson Corporation, MiniBlue(TM) Hot Melt Dispensing Guns, Brochure, 2003.

(Continued)

*Primary Examiner* — Frederick C. Nicolas
(74) *Attorney, Agent, or Firm* — Wood, Herron & Evans, L.L.P.

(57) ABSTRACT

A thermally insulated applicator for applying heated thermoplastic liquid includes an applicator body including a thermoplastic liquid supply passage and a heating element for supplying heat to liquid in the supply passage. A dispensing valve module is coupled in thermal contact with the applicator body and includes an outlet in fluid communication with the liquid supply passage. A cover assembly is formed of a thermally insulating plastic and includes first, second and third sides, the first and second sides of the cover assembly respectively covering the first and second sides of the applicator body, and the third side of the cover assembly covering the third side of the dispensing valve module. The first and second sides of the cover assembly each include a plurality of point contact projecting elements respectively supporting the first and second sides of the cover assembly on the first and second sides of the applicator body.

20 Claims, 6 Drawing Sheets

U.S. PATENT DOCUMENTS

| | | | | |
|---|---|---|---|---|
| 6,175,101 | B1 | 1/2001 | Miller et al. | |
| 6,499,629 | B1 | 12/2002 | Colangelo et al. | |
| 6,533,187 | B2 | 3/2003 | May | |
| 7,025,081 | B2 | 4/2006 | Colangelo et al. | |
| D552,716 | S | 10/2007 | Chastine et al. | |
| 7,626,143 | B2 * | 12/2009 | Miller | 219/421 |
| D647,380 | S | 10/2011 | Bondeson et al. | |
| 8,061,918 | B2 | 11/2011 | Skalitzky et al. | |
| 2002/0109019 | A1 | 8/2002 | May | |
| 2009/0294014 | A1 | 12/2009 | Sennrich | |

FOREIGN PATENT DOCUMENTS

| | | | |
|---|---|---|---|
| EP | 0855228 | A2 | 7/1998 |
| WO | 98/10251 | A1 | 3/1998 |

OTHER PUBLICATIONS

Nordson Corporation, MiniBlue(TM) II Hot Melt Dispensing Applicators, Brochure, 2010.

Nordson Corporation, Select Series (TM) Hot Melt Dispensing Guns and Hoses, Brochure, Apr. 2006.

* cited by examiner

THERMALLY INSULATED APPLICATOR

TECHNICAL FIELD

The present invention generally relates to devices for dispensing thermoplastic materials, such as hot melt adhesives, and comprised of an applicator body coupled in thermal communication with one or more dispensing valve modules and providing thermal insulation for covering the heated, outer surfaces of the device.

BACKGROUND

Applicators for dispensing thermoplastic liquids, such as hot melt adhesives, typically operate at highly elevated temperatures, such as above about 250° F. Various dispenser or applicator configurations have high temperature surfaces exposed to operating or maintenance personnel. The applicator typically comprise an applicator body and valve module formed from metals, such as aluminum, having high thermal conductivity. Various measures are taken to insulate the dispensing equipment from nearby personnel or otherwise prevent undesired exposure of the hot applicator surfaces to the personnel. For example, insulating coverings such as blankets or flexible outer pads have been used to thermally isolate the applicator. This can reduce the ease with which the equipment may be serviced. Various applicators have also been proposed that include rigid plastic covers for heat insulation purposes. In addition to the potential for exposure of personnel to the heated surfaces of the applicator, heat dissipation can increase the energy requirement to heat the adhesive or other thermoplastic material in the applicator.

For reasons such as these, it would be desirable to provide a thermally insulated applicator that can better prevent exposure of heated surfaces to personnel and also retain an optimum amount of heat in the applicator to provide better control and reduce the energy used by the applicator.

SUMMARY

The present invention generally provides a thermally insulated applicator for dispensing and applying heated thermoplastic liquids, such as hot melt adhesives. The applicator includes an applicator body with a thermoplastic liquid supply passage and a heating element for supplying heat to liquid in the supply passage. The applicator body further includes first and second opposite sides. A dispensing valve module is coupled in thermal contact with an outer surface of the applicator body and includes an outlet in fluid communication with the liquid supply passage. The dispensing valve module further includes first and second opposite sides located respectively along the first and second sides of the applicator body and a third side located between the first and second sides of the dispensing valve module. The applicator further includes a cover formed of a thermally insulating plastic and including first, second and third sides. The first and second sides of the cover respectively cover the first and second sides of the applicator body. The third side of the cover covers the third side of the dispensing valve module. The first and second sides of the cover each include a plurality of point contact projecting elements respectively supporting the first and second sides of the cover on the first and second sides of the applicator body. The plurality of point contact projecting elements are configured to space remaining portions of the first and second sides of the cover from the first and second sides of the applicator body.

In various other embodiments or aspects, the applicator may have different or additional features. For example, in a preferred embodiment, the first and second sides of the cover assembly further cover first and second sides of the dispensing valve module. The first, second and third sides of the cover comprise separate pieces releasably coupled together. For example, friction connecting elements integrally formed on each of the first, second and third sides of the cover may be used. In one embodiment, the only contact between the cover assembly and the applicator body consists of the plurality of point contact projecting elements.

In the preferred embodiment, first and second portions of the insulating material, which may be thin, compressible pads of fibrous insulation material, are positioned respectively between the first and second sides of the cover assembly and the first and second sides of the applicator body. A third portion of the insulating material is positioned between the third side of the dispensing valve module and the third side of the cover assembly. More preferably, the first and second portions of the insulating material are further positioned respectively between the first and second sides of the cover assembly and the first and second sides of the dispensing valve module. In this embodiment, the first and second portions of the insulating material are compressed against the first and second sides of the applicator body by the plurality of point contact projecting elements. The point contact projecting elements are positioned adjacent first and second holes respectively located in the first and second sides of the cover assembly. First and second fasteners respectively extend through the first and second holes and couple the first and second sides of the cover assembly to the first and second sides of the applicator body. First and second locating elements extend from each of the first and second sides of the cover assembly for locating the first and second portions of insulating material on the first and second sides of the cover assembly.

Various additional features of the invention will become more readily apparent to those of ordinary skill in the art upon review of the following detailed description of the illustrative embodiments, taken in conjunction with the accompanying drawings.

DETAILED DESCRIPTION

Figure 1:
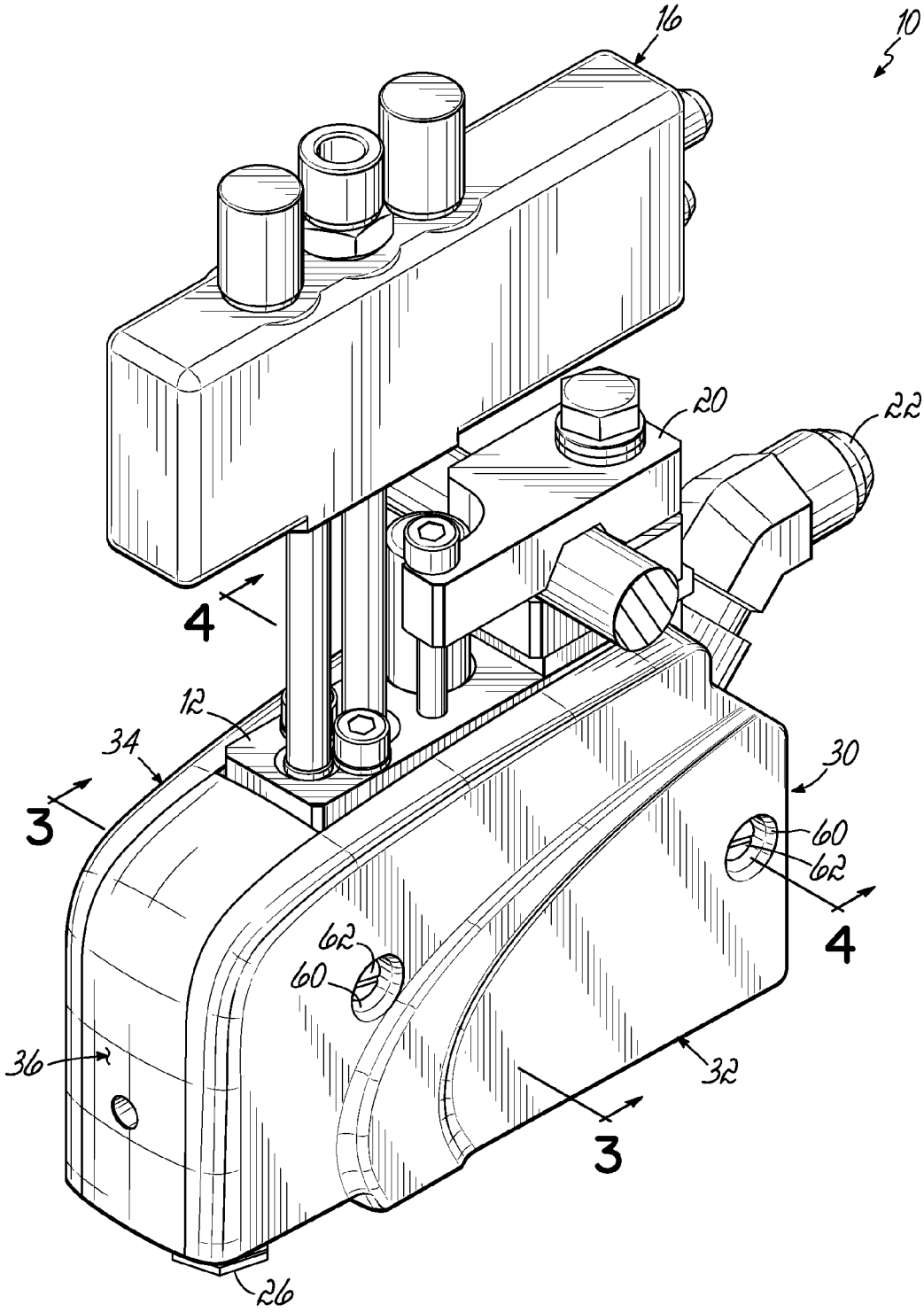
FIG. 1 is a front perspective view of a thermally insulated applicator constructed in accordance with an embodiment of the invention.
Figure 2:
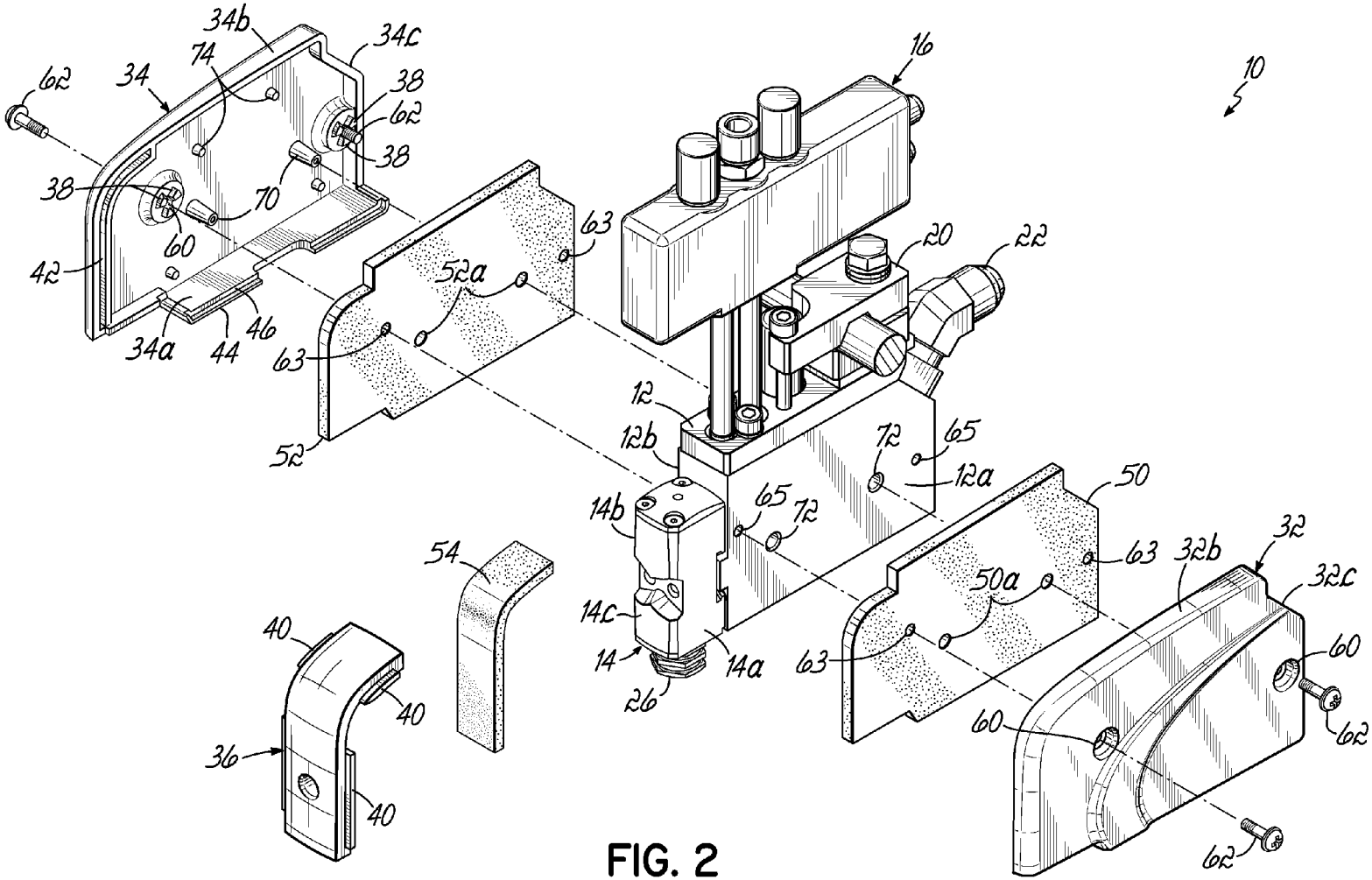
FIG. 2 is an exploded perspective view of the applicator shown in FIG. 1.
Figure 2A:
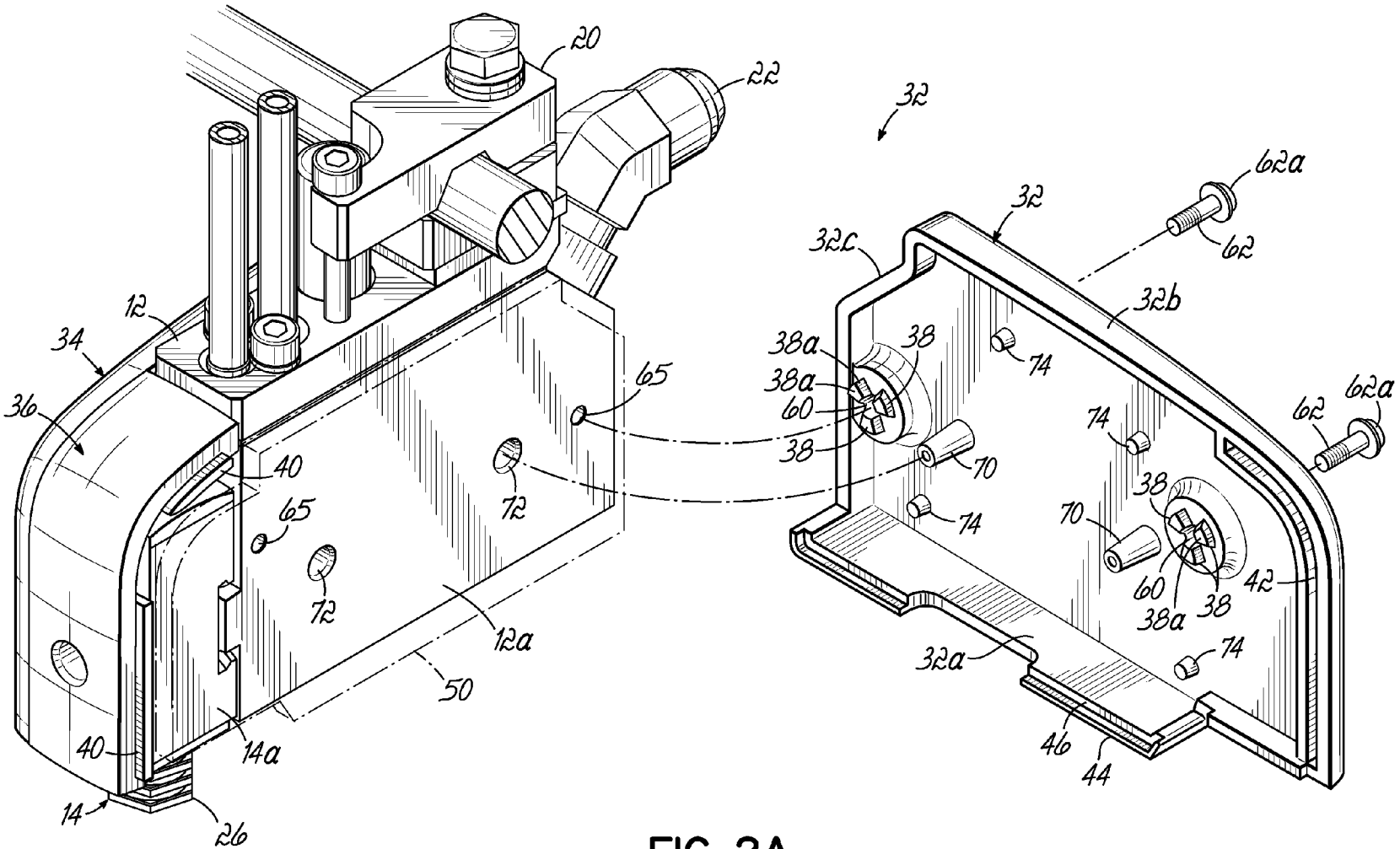
FIG. 2A is an enlarged, exploded perspective view showing one side of the cover assembly removed.

FIGS. 1, 2 and 2A illustrate a thermally insulated applicator 10, also known as a dispensing gun, constructed in accordance with a first illustrative embodiment of the invention. The applicator 10 generally includes an applicator body 12, which is sometimes referred to as a service module or manifold, a dispensing valve module 14 and a solenoid valve 16 for operating the valve module 14 (FIG. 2). The applicator body 12 has first and second opposite sides 12*a*, 12*b* (FIGS. 3 and 4), and the valve module 14 has first and second opposite sides 14*a*, 14*b* extending along applicator body sides 12*a*, 12*b* and a third side 14*c* located between sides 14*a*, 14*b*. The dispensing valve module 14 is coupled in thermal contact with the applicator body 12. This contact may be direct metal-to-metal contact as shown with an outside rear surface of the valve module 14 coupled in direct physical contact with an outside front surface of the applicator body 12. The applicator body 12 and the dispensing valve module 14 are each constructed of thermally conductive metal(s) such as aluminum. The solenoid valve 16 is coupled to the applicator body 12 in a known manner for supplying pressurized operating air to the valve module 14. One example of an applicator body 12, module 14 and solenoid valve 16 are available from Nordson Corporation of Westlake, Ohio and sold under the name MiniBlue™ hot melt dispensing guns. A mounting bracket assembly 20 is provided for allowing the applicator 10 to be mounted at a suitable location on a manufacturing line or other location.

Figure 3:
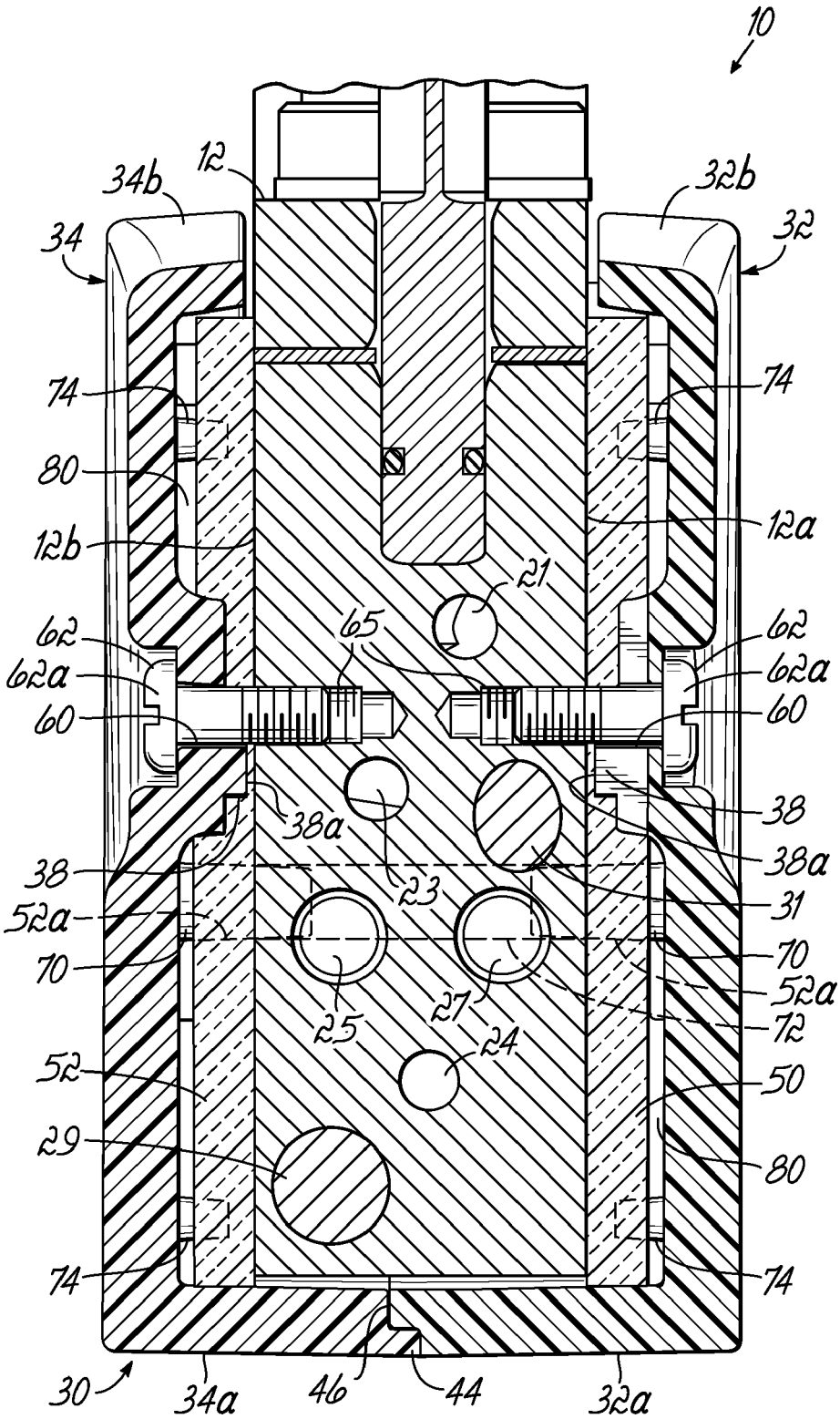
FIG. 3 is a cross sectional view taken along line 3-3 of FIG. 1.

The applicator body 12 includes a supply fitting 22 that serves as an inlet for receiving liquefied and heated thermoplastic material, such as hot melt adhesive. The inlet 22 communicates with a supply passage 24 (FIG. 3) in the applicator body 12 leading to passages in the valve module 14 and ultimately to the outlet, such as nozzle 26, of the valve module 14 in a known manner. The applicator body 12, dispensing valve module 14 and solenoid valve 16 comprise one of many possible assemblies that may be used in conjunction with the inventive aspects disclosed herein and, notably with a thermally insulating cover assembly 30 and one or more of its various aspects as discussed further below. Also shown in FIG. 3 are conventional passages 21, 23 for pressurized operating air to open and close the valve (not shown) associated with the module 14, and fastener holes 25, 27 that are unused. Finally, a cartridge heater 29 and RTD or resistance temperature detector 31 are provided for heating the applicator body 12 and valve module 14 to the required temperature and controlling the application temperature.

Figure 4:
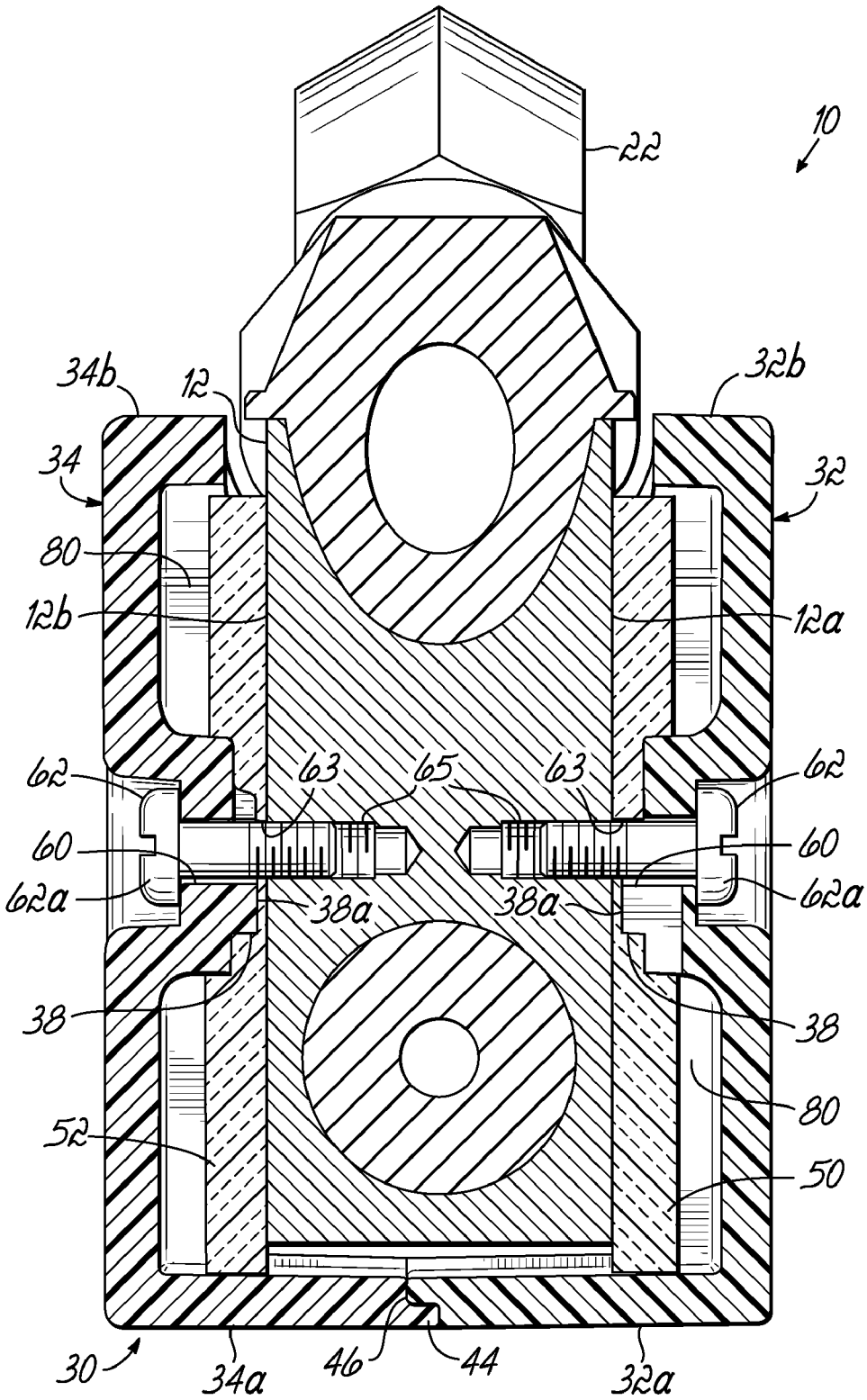
FIG. 4 is a cross sectional view taken along line 4-4 of FIG. 1.

As best shown in FIGS. 2-4, a thermally insulating cover assembly 30 is provided in accordance with an illustrative embodiment. In this embodiment, the cover assembly 30 comprises three separate pieces or sections, each of which is formed of a thermally insulating plastic material, such as polyphenylene sulfide (PPS), or any other thermally insulating plastic material, which may or may not be reinforced with other materials such as fiberglass or other materials. One suitable material is available from Chevron Phillips Chemical Co. of The Woodlands, Tex., under the name Ryton®. The cover assembly includes first, second and third sides 32, 34, 36 which, in this embodiment, correspond with separate sections or pieces. While the illustrated embodiment includes three separate pieces 32, 34, 36 that are snap fit or friction fit together, it will be appreciated that the cover assembly may be formed instead from more or less pieces. In one form, a cover is contemplated that includes three sides, but is integrally formed, molded or otherwise constructed in one piece. Such a one-piece construction would be simple, but certain compromises would likely have to be made to allow the cover to be located on and secured to the applicator body 12 and attached valve module 14. For example, the first and second opposite sides 12*a*, 12*b* of the applicator body 12 and the first and second sides 14*a*, 14*b* of the valve module 14, as well as the front or third side 14*c* of the valve module 14 and part of the top may be covered by an integral, one-piece cover, however portions of the bottom and/or rear surfaces thereof may be more exposed. In another possible embodiment, two separate and opposing cover pieces could be manufactured and coupled together in a manner similar to the couplings shown and described herein or with other means. In this type of embodiment, for example, front portions of each of the side pieces or sections 32, 34 could be extended around the front or third side 14*c* of the dispensing valve module 14 and snap or friction fit together, thus eliminating the need for a separate third piece 36.

The first and second sides 32, 34 of the cover assembly 30 respectively cover the first and second sides 12*a*, 12*b* of the applicator body 12. The third side 36 of the cover assembly 30 covers the third side 14*c* of the dispensing valve module 14. The first and second sides 32, 34 of the cover assembly 30 each include a plurality of point contact projecting elements 38 respectively supporting the first and second sides 32, 34 of the cover assembly 30 on the first and second sides 12*a*, 12*b* of the applicator body 12.

Figure 4A:
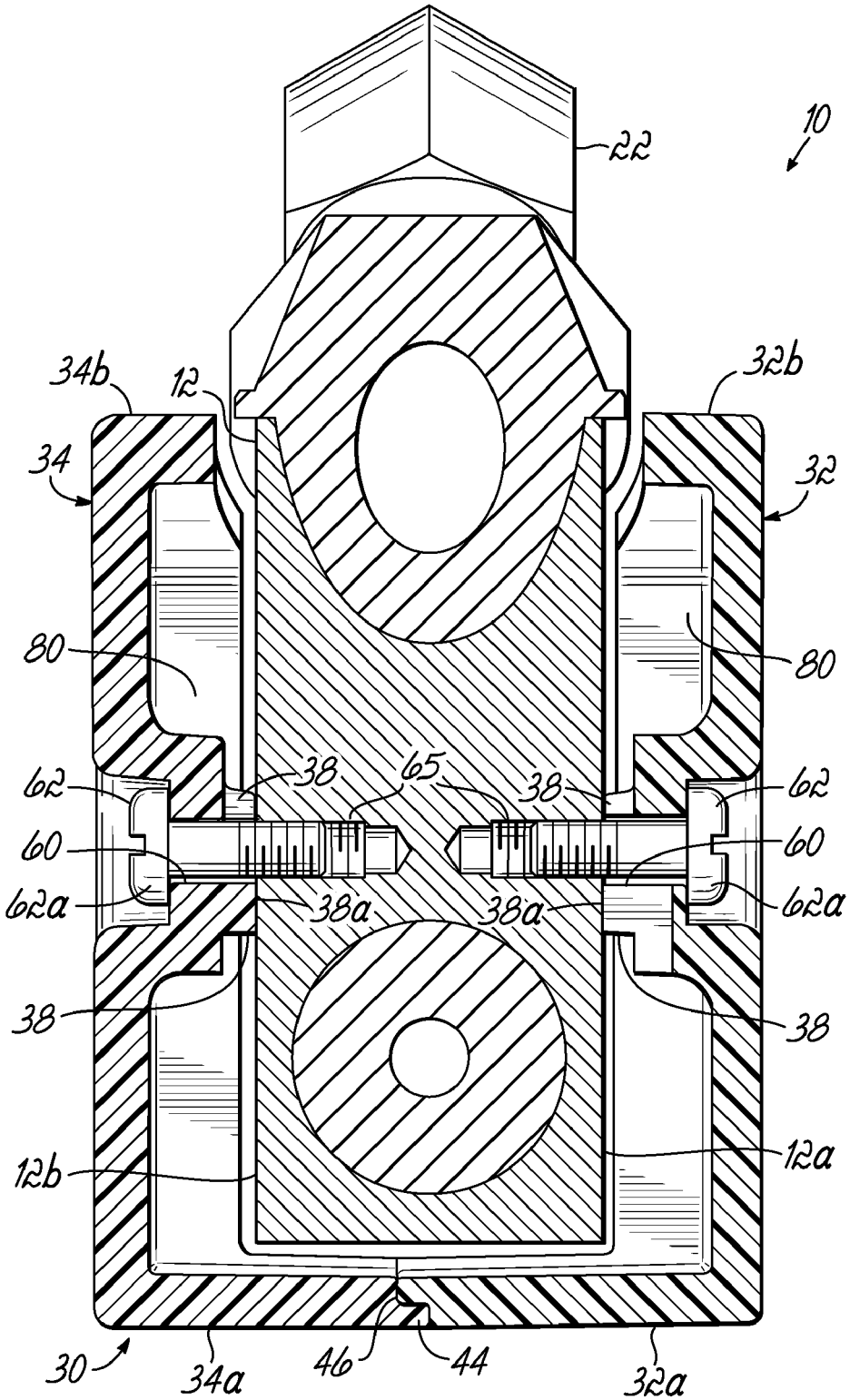
FIG. 4A is a cross sectional view similar to FIG. 4, but illustrating an alternative embodiment.

As shown in FIGS. 3 and 4, the projecting elements 38 support first and second sides 32, 34 of the cover assembly 30 indirectly by bearing against insulating material 50, 52 and compressing that insulating material 50, 52 respectively against the side surfaces 12*a*, 12*b* of the applicator body 12, as discussed further below. Alternatively, as shown in FIG. 4A, the insulating material may be eliminated and the cover assembly 30 may be supported by contact of the projecting elements 38 directly against the outer side surfaces 12*a*, 12*b* of the applicator body 12.

The first and second sides 32, 34 of the cover assembly 30 not only cover the first and second sides 12*a*, 12*b* of the applicator body 12, but also extend forwardly to cover the first and second sides 14*a*, 14*b* of the dispensing valve module 14. The first, second and third sides 32, 34, 36 of the cover assembly 30 comprise separate pieces as shown best in FIG. 2, which releasably couple together. In this embodiment, the releasable coupling is provided with friction connecting elements integrally formed on each of the first, second and third sides 32, 34, 36 of the cover assembly 30, such as by being molded therewith. It will be appreciated that projecting elements 38 may also be molded or otherwise integral with sides 32, 34. The connecting elements more particularly comprise projecting tabs 40 on the third or front side 36 of the cover assembly 30 that are inserted within slots or recesses 42 in the first and second sides 32, 34 of the cover assembly 30, as well as similar tabs 44 and receiving slots 46 at the lower end of each of the first and second sides 32, 34 of the cover assembly 30. Preferably, whether the direct contact embodiment is used as shown in FIG. 4A, or the indirect contact embodiment is used as shown in FIGS. 3 and 4, the only supporting points or contact points between the cover assembly 30 and the outer hot surfaces of the applicator body 12 are at the locations of the point contact projecting elements 38. This significantly reduces the thermal conduction that occurs between the applicator body 12, valve module 14 and cover assembly 30.

As shown further in FIGS. 3 and 4, to facilitate further coverage of the applicator body 12 and valve module 14, the cover assembly 30 includes a bottom comprised of side portions 32*a*, 34*a* that extend around the bottom of the applicator body 12, and a top comprised of side portions 32*b*, 34*b* that extend around the top of the applicator body 12. In addition, as shown in FIGS. 2 and 2A, side portions 32*c*, 34*c* extend around the rear surface of the applicator body 12. Although not shown, a pad of insulating material may also be located inside the cover assembly 30 at the rear surface of the applicator body 12.

As mentioned previously, to further enhance the thermal insulation value of the cover assembly 30, the cover assembly 30 includes at least first and second portions 50, 52 of the insulating material positioned respectively between the first and second sides 32, 34 of the cover assembly and the first and second sides 12*a*, 12*b* of the applicator body 12, and a third portion 54 of insulating material positioned between the third side 14*c* of the dispensing valve module 14 and the third side 36 of the cover assembly 30. The specific insulation material chosen for pads 50, 52, 54 may vary, but a suitable material is an aramid fiber pad with a thickness of about 0.375". More preferably, the first and second portions 50, 52 of the insulating material are further positioned respectively between the first and second sides 32, 34 of the cover assembly 30 and the first and second sides 14*a*, 14*b* of the dispensing valve module 14.

As shown in FIGS. 3 and 4, the first and second portions 50, 52 of the insulating material are compressed against the first and second sides 12*a*, 12*b* of the applicator body 12 by the plurality of point contact projecting elements 38. As further shown in FIGS. 3 and 4, the point contact projecting elements 38 are positioned adjacent holes 60 located in the first and second sides 32, 34 of the cover assembly 30. The holes 60 receive fasteners 62 that extend through holes 63 in the insulation pads 50, 52 and are threaded into holes 65 the applicator body 12 for fastening the cover assembly 30 to the applicator body 12. As the fasteners 62 are tightened down, as illustrated in FIGS. 3 and 4, the cover assembly 30 will be secured to the applicator body 12 preferably with no portion of the plastic cover assembly 30 being in direct contact with any heated surface of the applicator body 12 or the dispensing valve module 14. In this embodiment, the area of highest thermal conductivity will be at the location of the point contact projecting elements 38 where the insulating material 50, 52 is compressed. Because of the insulating value of the insulating material, and the small surface area of the point contact projecting elements 38, this thermal conductivity will be minimized.

As illustrated best in FIG. 2A, the projecting elements 38 are substantially pie-shaped and include flat outer contact surfaces 38*a* that engage against the insulation. These point contact projecting elements may have many other suitable shapes while facilitating the same function, including ring-shapes disposed about holes 60. They should have non-sharpened contact surfaces, which are preferably flat, that engage the insulation without puncturing it as the cover assembly 30 is fastened to the applicator body 12. In this embodiment, the point contact projecting elements 38 extend radially from the fastener holes 60 by a distance sufficient to provide physical support for the fastener head 62*a*. For example, this distance may be at least approximately equal to the diameter of the fastener head 62*a*. While these projecting elements 38 are shown in the radially extending positions about the fastener holes 60, it will be appreciated that they may be located elsewhere as an alternative or in addition to the locations shown. Locations positioned proximate to, but not necessarily radially about, the fastener openings 60 are advantageous to provide physical support for the cover sections on the applicator body as the fasteners 60 are tightened down.

Referring again to FIGS. 2 and 2A, side pieces 32, 34 of the cover assembly 30 each include locating elements 70 to facilitate the physical location of the cover sections 32, 34 on opposite sides of the applicator body 12. Specifically, the locating elements 70 are tapered indexing members that will extend through respective holes 50*a*, 52*a* in the insulating pads 50, 52 and then extend into throughholes 72 in the applicator body 12. Once the cover assembly 30 is fastened in place, these locating elements 70 will not contact the applicator body 12, but will be centered within the throughholes 72 so as to reduce heat transfer. In another aspect, small projecting tabs or stand-offs 74 are provided on the inside surfaces of the cover sections 32, 34. These stand-offs 74 have a height such that they engage and slightly compress the insulation pads 50, 52 as indicated in FIG. 3, for example, however they do not apply compression to the extent of the projecting elements 38. The purpose of these stand-offs 74 is to provide physical support for the sides 32, 34 of the cover assembly 30 in the event that a force is applied to the outside of the cover assembly 30, such as a forceful impact. In such an event, the presence of the stand-offs 74 will provide structural support and help prevent the cover assembly 30 from breaking or fracturing. In addition, these small standoffs 74 ensure that the insulation 50, 52 is held against the applicator body 12 where it will provide optimum insulation.

In the embodiments of FIGS. 1-4, it will be appreciated that when the insulation 50, 52 is compressed, for example, to a thickness of approximately 0.3 mm, its insulation value will be greatly reduced in the compressed areas. However, the overall effect of this compression is minimized by the fact that only a very small percentage of the total insulation area of the cover assembly 30 is affected and the remainder of the insulation 50, 52, 54 remains fully uncompressed and retains its fully insulation value. In the preferred embodiment the percentage of the total contact area of the projections 38 relative to the total insulation area of the cover is less than about 3%. Most preferably, this percentage is about 1%. In addition, in both the first embodiment and the second embodiment (FIG. 4A) thermally insulating air spaces 80 provide high insulation value, while the contact areas of the projecting elements 38 provide very limited pathways for heat conduction from the hot surfaces of the applicator body 12 to the cover portions 32, 34, 36. Finally, the height of the projecting elements 38 can be varied to control the conduction of heat energy. Allowing for practical design considerations, the height of the projecting elements is maximized to provide additional insulation value.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A thermally insulated applicator for applying heated thermoplastic liquid, comprising:

an applicator body including a thermoplastic liquid supply passage and a heating element for supplying heat to liquid in the supply passage, the applicator body further including first and second opposite sides, a dispensing valve module coupled in thermal contact with an outer surface of the applicator body and including an outlet in fluid communication with the liquid supply passage, the dispensing valve module further including first and second opposite sides located respectively along the first and second sides of the applicator body and a third side located between the first and second sides of the dispensing valve module, and a cover formed of a thermally insulating plastic and including first, second and third sides, the first and second sides of the cover respectively covering the first and second sides of the applicator body, and the third side of the cover covering the third side of the dispensing valve module, the first and second sides of the cover each including a plurality of point contact projecting elements respectively supporting the first and second sides of the cover on the first and second sides of the applicator body, the plurality of point contact projecting elements configured to space remaining portions of the first and second sides of the cover from the first and second sides of the applicator body.

2. The applicator of claim 1, wherein the first and second sides of the cover further cover the first and second sides of the dispensing valve module.

3. The applicator of claim 1, wherein the first, second and third sides of the cover comprise at least two separate pieces releasably coupled together.

4. The applicator of claim 3, wherein the separate pieces of the cover are releasably coupled together with friction connecting elements integrally formed on each of the first, second and third sides of the cover.

5. The applicator of claim 1, further comprising:

first and second portions of insulating material positioned respectively between the first and second sides of the cover and the first and second sides of the applicator body, and a third portion of insulating material positioned between the third side of the dispensing valve module and the third side of the cover.

6. The applicator of claim 5, wherein the first and second portions of the insulating material are further positioned respectively between the first and second sides of the and the first and second sides of the dispensing valve module.

7. The applicator of claim 5, wherein the first and second portions of the insulating material are compressed against the first and second sides of the applicator body by the plurality of point contact projecting elements.

8. The applicator of claim 5, wherein the point contact projecting elements are positioned adjacent first and second holes respectively located in the first and second sides of the cover, and further comprising first and second fasteners respectively extending through the first and second holes and coupling the first and second sides of the cover to the first and second sides of the applicator body.

9. The applicator of claim 5, further comprising:

first and second locating elements extending from each of the first and second sides of the cover and extending into holes in the first and second portions of insulating material and additional holes in the applicator body.

10. The applicator of claim 1, wherein the point contact projecting elements comprise structure positioned adjacent first and second holes respectively located in the first and second sides of the cover, and the cover further comprises an assembly including first and second fasteners respectively extending through the first and second holes and coupling the first and second sides of the cover to the first and second sides of the applicator body.

11. The applicator of claim 10, wherein a plurality of point contact projecting elements are located radially about each of the first and second holes.

12. The applicator of claim 11, wherein the plurality of point contact projecting elements are arranged in a circular pattern about each of the first and second holes and extend a radial distance from each hole that is sufficient to provide structural support for heads of the first and second fasteners.

13. The applicator of claim 1, wherein the point contact projecting elements have a total contact surface area of less than about 3% relative to a total insulating area of the cover.

14. The applicator of claim 13, wherein the total contact surface area is less than or equal to about 1%.

15. The applicator of claim 1, further comprising a plurality of stand-of elements extending from inner surfaces of the first and second sides of the applicator body by a distance less than the point contact projecting elements for providing support to the first and second sides in the event of an impact force.

16. A thermally insulated applicator for applying heated thermoplastic liquid, comprising:

an applicator body including a thermoplastic liquid supply passage and a heating element for supplying heat to liquid in the supply passage, the applicator body further including first and second opposite sides, a dispensing valve module coupled in thermal contact with an outer surface of the applicator body and including an outlet in fluid communication with the liquid supply passage, the dispensing valve module further including first and second opposite sides located respectively along the first and second sides of the applicator body and a third side located between the first and second sides of the dispensing valve module, a cover formed of a thermally insulating plastic and including first, second and third sides, the first and second sides of the cover respectively covering the first and second sides of the applicator body, and the third side of the cover covering the third side of the dispensing valve module, the first and second sides of the cover each including first and second holes and a point contact projecting element positioned adjacent each hole and supporting the first and second sides of the cover on the first and second sides of the applicator body, the point contact projecting elements configured to space remaining portions of the first and second sides of the cover from the first and second sides of the applicator body, first and second portions of insulating material positioned respectively between the first and second sides of the cover and the first and second sides of the applicator body, and a third portion of insulating material positioned between the third side of the dispensing valve module and the third side of the cover, and first and second fasteners respectively extending through the first and second holes and coupling the first and second sides of the cover to the first and second sides of the applicator body such that the first and second portions of insulating material are compressed against the respective first and second sides of the applicator body by the point contact projecting elements.

17. The applicator of claim 16, wherein a plurality of point contact projecting elements are located radially about each of the first and second holes.

18. The applicator of claim 17, wherein the plurality of point contact projecting elements are arranged in a circular pattern about each of the first and second holes and extend a radial distance from each hole that is sufficient to provide structural support for the first and second fasteners.

19. The applicator of claim 16, wherein the point contact projecting elements have a total contact surface area of less than about 3% relative to a total insulating area of the cover.

20. The applicator of claim 16, wherein the total contact surface area is less than or equal to about 1%.

* * * * *

UNITED STATES PATENT AND TRADEMARK OFFICE

CERTIFICATE OF CORRECTION

PATENT NO. : 8,210,398 B2
APPLICATION NO. : 12/826266
DATED : July 3, 2012
INVENTOR(S) : Benjamin J. Bondeson et al.

It is certified that error appears in the above-identified patent and that said Letters Patent is hereby corrected as shown below:

Column 1

Line 19, change “comprise” to --comprises--.

Column 3

Line 15, change “are” to --is--.

Column 5

Line 22, after “65” insert --of--.

Column 6

Line 22, change “fully” to --full--.

Column 7

Claim 6, line 30, after the second occurrence of “the” insert --cover--.

Column 8

Claim 15, line 7, change “stand-of” to --stand-off--.

Signed and Sealed this
Fourth Day of September, 2012

David J. Kappos
*Director of the United States Patent and Trademark Office*